US009545667B2

(12) United States Patent
Yasuda et al.

(10) Patent No.: US 9,545,667 B2
(45) Date of Patent: Jan. 17, 2017

(54) CASTING MACHINE

(71) Applicant: DENSO CORPORATION, Kariya, Aichi-pref. (JP)

(72) Inventors: Kazumasa Yasuda, Anjo (JP); Yuji Sakakibara, Obu (JP); Naoto Uesaka, Chita-gun (JP); Atsushi Yamashita, Anjo (JP)

(73) Assignee: DENSO CORPORATION, Kariya (JP)

( * ) Notice: Subject to any disclaimer, the term of this patent is extended or adjusted under 35 U.S.C. 154(b) by 183 days.

(21) Appl. No.: 14/229,094

(22) Filed: Mar. 28, 2014

(65) Prior Publication Data

US 2014/0291361 A1 Oct. 2, 2014

(30) Foreign Application Priority Data

Mar. 28, 2013 (JP) ..... 2013-068546
Jan. 10, 2014 (JP) ..... 2014-003042

(51) Int. Cl.

| | |
|---|---|
| ***B22D 17/20*** | (2006.01) |
| ***B22D 41/01*** | (2006.01) |
| ***B22D 17/28*** | (2006.01) |
| ***B22D 18/04*** | (2006.01) |

(52) U.S. Cl.

CPC ..... *B22D 41/01* (2013.01); *B22D 17/2015* (2013.01); *B22D 17/28* (2013.01); *B22D 18/04* (2013.01)

(58) Field of Classification Search

CPC ..... B22D 41/01; B22D 17/2015; B22D 17/28; B22D 18/04

USPC ..... 222/590, 591, 593; 266/212, 242, 900, 266/236; 432/156, 158

See application file for complete search history.

(56) References Cited

U.S. PATENT DOCUMENTS

| | | | | |
|---|---|---|---|---|
| 3,464,687 A * | 9/1969 | Chang | C21O 5/567 266/215 |
| 5,879,721 A * | 3/1999 | Bradley | B22C 9/08 164/130 |
| 7,235,210 B2 * | 6/2007 | Nakashima | C22B 21/0084 266/242 |
| 2006/0027953 A1 | 2/2006 | Nakashima | |

FOREIGN PATENT DOCUMENTS

| | | | |
|---|---|---|---|
| JP | A-8-99168 | 4/1996 | |
| JP | A-9-176754 | 7/1997 | |
| JP | A-2005-964 | 1/2005 | |
| JP | A-2005-76972 | 3/2005 | |
| JP | A-2006-71266 | 3/2006 | |
| JP | A-2008-224089 | 9/2008 | |
| JP | 2010260068 | * 11/2010 | B22D 17/2015 |
| JP | A-2010-260068 | 11/2010 | |
| JP | A-2012-55902 | 3/2012 | |

* cited by examiner

*Primary Examiner* — Jessee Roe
*Assistant Examiner* — Michael Aboagye
(74) *Attorney, Agent, or Firm* — Oliff PLC

(57) ABSTRACT

A casting machine having a furnace body, a first heater, a first surface and pressure means. The furnace body has a melting portion and a holding portion, material being supplied and melted to form the molten metal in the melting portion, the holding portion holding the molten metal which has flowed out from the melting portion. The first heater heats the material supplied to the melting portion to melt it. The first surface is provided on a hearth surface of the melting portion and has concavities and convexities, the material to be heated being laid on the first surface.

16 Claims, 9 Drawing Sheets

CASTING MACHINE

CROSS-REFERENCE TO RELATED APPLICATION

This application is based on and claims the benefit of priority from earlier Japanese Patent Application No. 2013-68546 filed Mar. 28, 2013, and earlier Japanese Patent Application No. 2014-3042 filed Jan. 10, 2014, the description of which is incorporated herein by reference.

BACKGROUND

Technical Field

The invention relates to a casting machine melting material to be molten metal.

Related Art

Patent document 1 (Japanese patent application publication 2006-71266) discloses a melting furnace used in a manufacturing line. The furnace body of this melting furnace has a melting chamber where a heating plate is provided, a processing portion connected to the melting chamber through a communicating hole, a holding portion connected to the processing portion through a communicating portion. The material supplied to the melting chamber is melted by the heating plate, thereafter passes down an oblique floor of the communicating hole to flow into the processing portion, followed by flowing into the holding portion through the communicating portion. In the processing portion, work for removing impurities such as metallic oxide is performed, thereby a part of the impurities that have occurred at melting, on the top surface of the molten metal is removed.

In the melting furnace of Patent document 1, the impurities on the top surface of the molten metal are blocked by a separating wall provided in the processing portion, however, the impurities which have been mixed into the molten metal, for example, during flowing after melting, flow as they are into the holding portion.

SUMMARY

The present disclosure provides a casting machine having means which can keep impurities that occur at melting to be remained in a melting portion, thereby preventing the impurities from mixing into molten metal, supplying the molten metal having good quality to a die.

An exemplary embodiment provides a casting machine having a furnace body, a first heater, a first surface and pressure means. The furnace body has a melting portion and a holding portion, material being supplied and melted to be the molten metal in the melting portion, the holding portion holding the molten metal which has flowed out from the melting portion. The first heater heats the material supplied to the melting portion to melt. The first surface is provided on a hearth surface of the melting portion and has concavities and convexities, the material to be heated being laid on the first surface. The pressure means is for pressurizing the molten metal to be forced into the die.

The material on the first surface is separated into layers of the molten metal and impurities. The impurities occur such as to cover the molten metal in a state where a part thereof contacts the first surface. The molten metal, whose viscosity is comparatively small, flows into the holding portion through the first surface. On the other hand, since the viscosity of the layer of the impurities is comparatively large, the impurities are trapped on the first surface. This can prevent the impurities from flowing into the molten metal in the holding portion, thereby securing good quality of the molten metal.

In the claims, if not otherwise specified, extending upward means not only extending straight upward but also extending obliquely upward, and extending downward means not only extending straight downward but also extending obliquely downward.

DETAILED DESCRIPTION OF PREFERRED EMBODIMENTS

Figure 1:
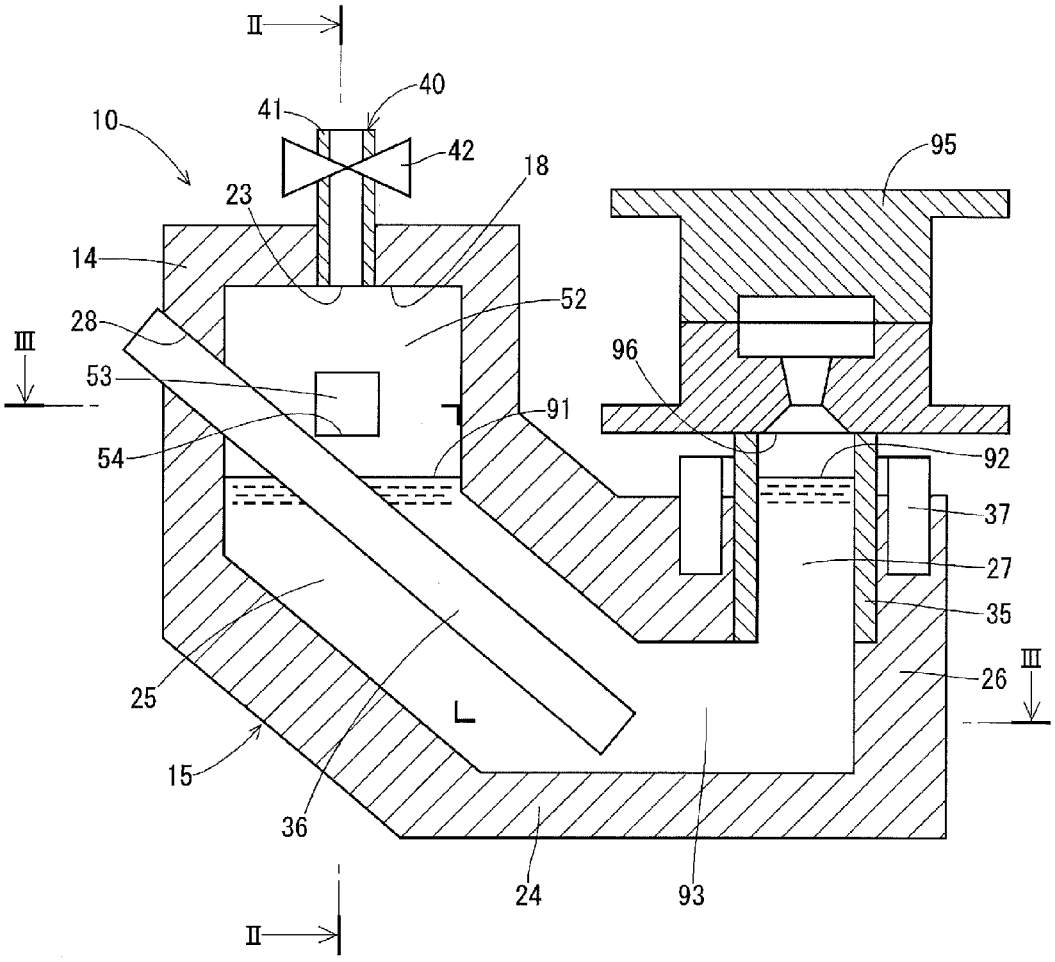
FIG. 1 is a cross-sectional view showing a schematic configuration of a casting machine according to a first embodiment.

Embodiments are now described, referring to the drawings.

(First Embodiment)

A first embodiment is shown in FIGS. 1 to 4. A casting machine 10 of this embodiment has a furnace body 15, a hot plate 30, a stalk 35, a second heater 36, a third heater 37 and pressure means.

The furnace body 15 forms a melting portion 16 (see FIGS. 2-4), a holding portion 24 and an output portion 26. Specifically, in this embodiment, the furnace body 15 has a melting chamber 17 and a holding chamber 14, the melting portion 16 being formed in the melting chamber 17, the holding portion 24 and an output portion 26 being formed in the holding chamber 14, the two chambers 17, 14 being communicated with each other through a communication passage 53.

In the melting chamber 17, material is molten. The melting chamber 17 has a material inlet port 19 at the ceiling surface 18 thereof. The material inlet port 19 is communicated with a cylindrical material inlet member 21 extending upward therefrom. The material inlet member 21 has a supply valve 22 for opening or closing the upper end thereof.

The holding portion 24 has a first passage 25 extending below the melting chamber 17, more specifically below the position of the part connecting to the communicating passage 53, downward. The output portion 26 has a second passage 27 communicated with the first passage 25, more specifically communicated with the molten metal pooled in the first passage 25. In this embodiment, the second passage 27 is connected to the lower end of the first passage 25 and extending upward.

The hot plate 30 is provided below the material inlet portion 19 and on the floor surface (hearth surface) of the melting chamber 17. The hot plate 30 corresponds to a first heater in the claims. The hot plate 30 has a first surface 31 on which the material is laid. The hot plate 30 heats the material supplied through the material inlet portion 21 to a first space 51 (inner space of the melting chamber 17) and laid on the first surface 31 to melt. In this embodiment, a plate portion of the hot plate 30, including the first surface 31, is made of silicon nitride.

The stalk 35 is a cylindrical member connecting between the furnace body 15 and a pouring port 96 of a die 95, and corresponds to the connection member in the claims. In this embodiment, the stalk 35 is made of silicon nitride. The stalk 35 is inserted into the second passage 27, and the inner diameters of the stalk 35 and the second passage 27 are the substantially same as the diameter of the pouring port 96.

The second heaters 36 is inserted from the outside of the furnace body 15 into the inside thereof. The molten metal 93 pooled in the first and second passages 25, 27 is heated at a predetermined temperature.

The third heater 37 is provided at the radial outside of the stalk 35, suppresses the reduction in temperature of the molten metal 93.

The pressure means 40 has a gas supply pipe 41, a supply valve 42 and an unshown gas supply source. The gas supply pipe 41 extends upward from an gas supply port 23 formed at the ceiling surface of the holding chamber 14. The supply valve 42 is provided on the gas supply pipe 41, opens and closes the gas supply pipe 41. The gas supply source supplies compressed gas (air in this embodiment) to the holding chamber 14 of the furnace body 15 through the gas supply pipe 41. As the gas supply source, for example, an air compressor can be used. The pressure means 40 applies pressure on the first top surface 91 of the molten metal in the first passage 25 to push the first top surface 91 down and the second top surface 92 up, thereby pouring the molten metal into the mold cavity of the die 95.

Next, the characteristic portion of the casting machine 10 is described, referring to FIGS. 1 to 8.

The furnace body 15 has the communicating passage 53 connecting between the first space 51 where the hot plate 30 is disposed and a second space 52 formed over the first passage 25. In this embodiment, the communicating passage 53 is formed by a hole penetrating a connection member connecting between the two chambers 17, 14, therefore the chamber walls of the two chambers 17, 14 corresponding to the division wall in the claims. The bottom surface 54 of the communicating passage 53 is oblique to descend to the second space 52 from the first space 51 (see FIG. 2). The first surface 31 of the hot plate 30 is disposed at higher position than the position of the molten metal 91 in the first passage 25, and oblique to descend to the inlet port of the communicating passage 53 (see FIG. 4).

Figure 3:
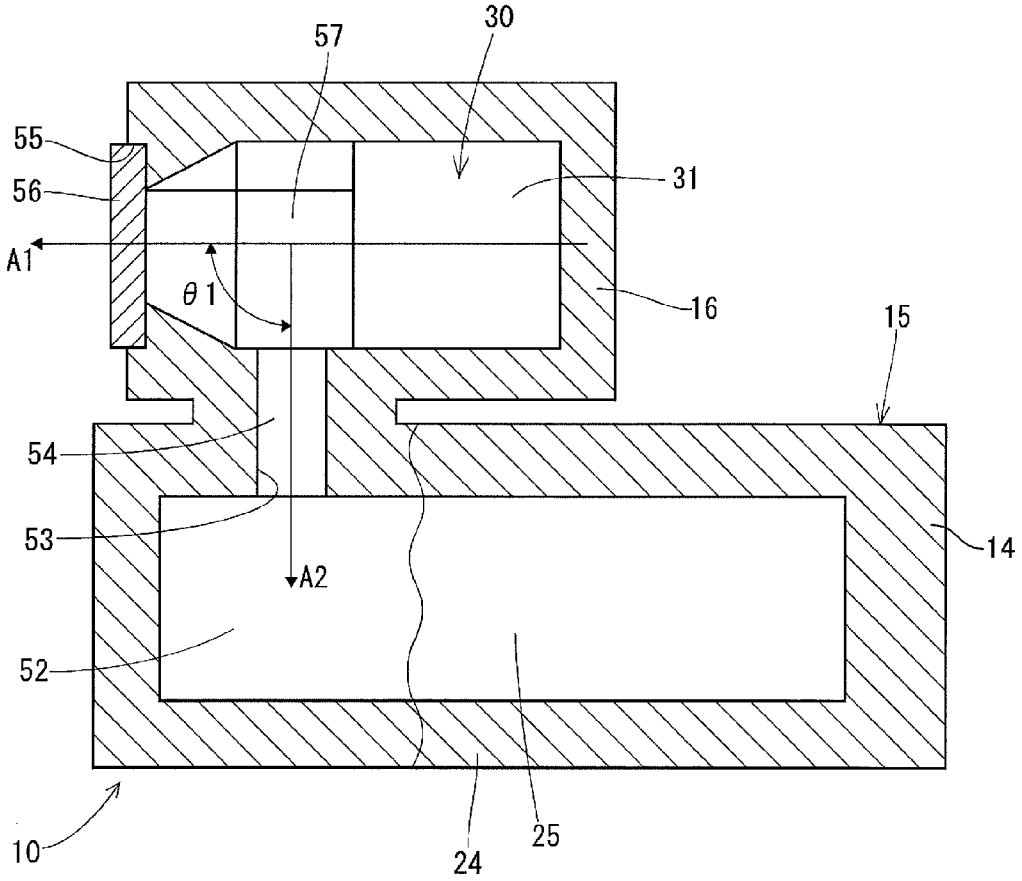
FIG. 3 is a cross-sectional view taken from line III-III of FIG. 1.

Here, the downward direction of the oblique directions of the first surface 31, defined as a first direction, is shown in FIG. 3 with the arrow A1. The downward direction of the oblique directions of the bottom 54 of the communicating passage 53, defined as a second direction, is shown in FIG. 3 with the arrow A2. When the furnace body 15 is viewed from above, i.e. viewed along the vertical direction, the first direction A1 and the second direction A2 intersect with each other. In this embodiment, the intersection angle θ1 between the first and second directions A1, A2 is 90°. In other words, the oblique direction of the first surface 31 is set such that the intersection direction angle θ1 is 90°.

Figure 8:
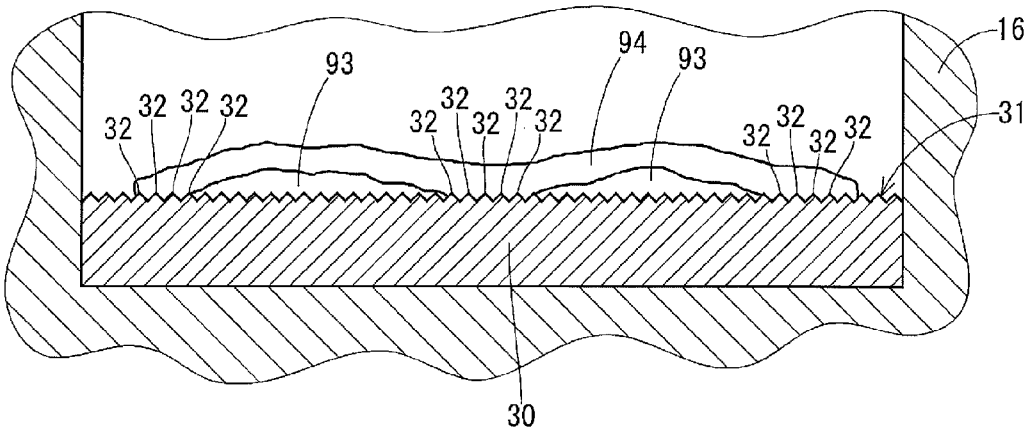
FIG. 8 is a cross-sectional view taken from line VIII-VIII of FIG. 6.

FIG. 8 shows a cross-sectional view of the first surface 31, the cross section is perpendicular to the oblique direction of the first surface 31. As shown in FIG. 8, the first surface 31 has concavities and convexities. In this embodiment, the concavities and convexities of the first surface 31 are formed from a plurality of conical projections 32 and hollows between the projections 32, and the surface roughness of the first surface 31 is set larger than that of the bottom surface 54 of the communicating passage 53.

Figure 2:
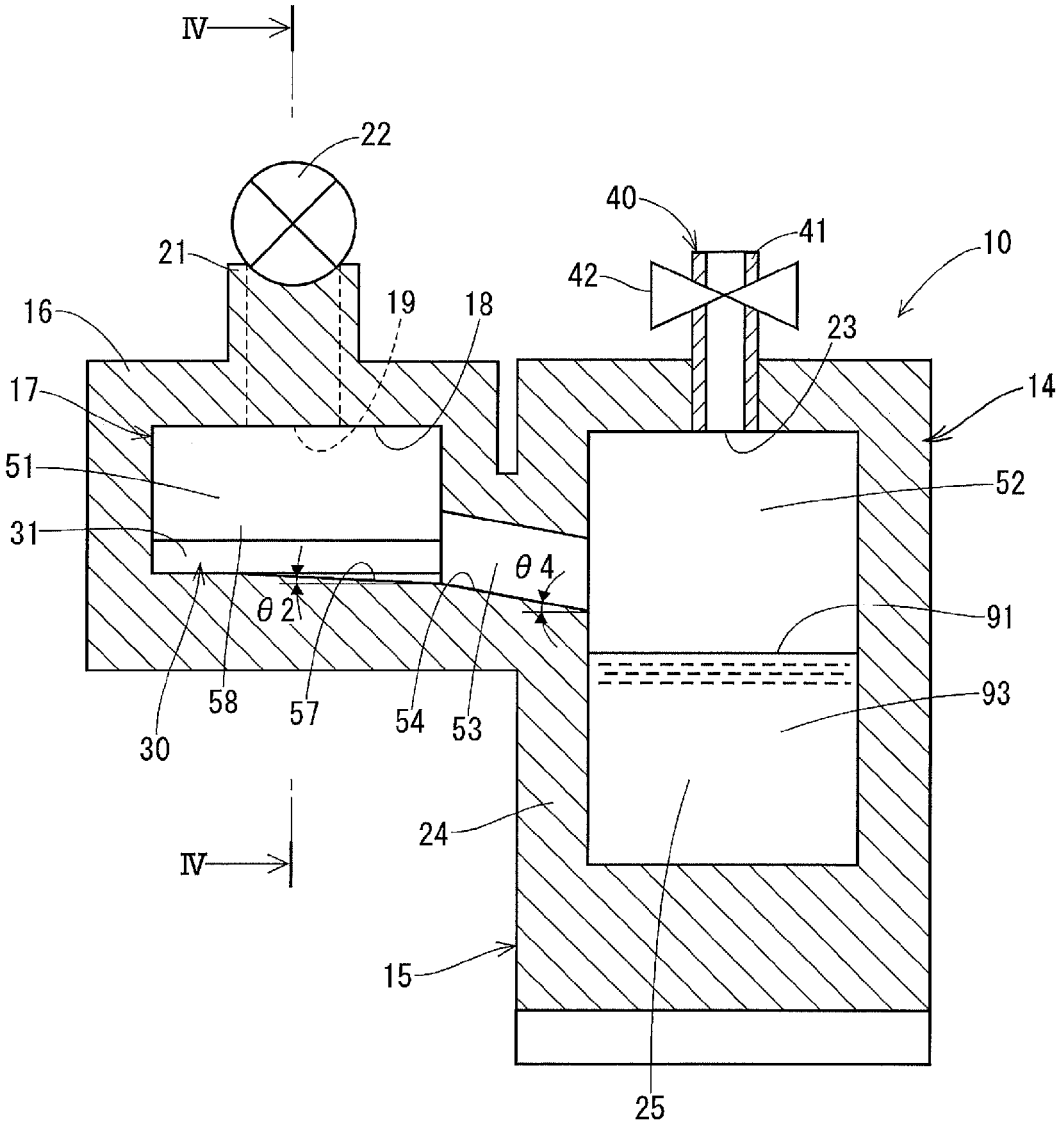
FIG. 2 is a cross-sectional view taken from line II-II of FIG. 1.

Further, a mildly-oblique surface 57 is provided between the first surface 31 and the bottom surface 54 of the communicating passage 53, as shown in FIG. 2. The oblique angle θ2 of the mildly-oblique surface 57 to the horizontal plane is set smaller than the oblique angle θ3 of the first surface 31 to the horizontal plane and the oblique angle θ4 of the bottom surface 54 to the horizontal plane.

The melting chamber 17 of the furnace body 15 has an opening 55 formed in the downward direction of the first surface 31. The opening 56 is opened and closed with a door 56.

When molten on the first surface 31, the material 90 is separated into a layer of the molten metal 93 and another layer of dross 94, as shown in FIGS. 4 to 8. The dross 94 is an impurity containing metallic oxides etc., and occurs such as to cover the molten metal 93 in a state where a part thereof contacts the first surface 31. The molten metal 93, whose viscosity is comparatively small, flows into the first passage 25 through the first surface 31, the mildly-oblique surface 57 and the bottom surface 54 of the communicating passage 53. On the other hand, since the viscosity of the dross 94 is comparatively large, the dross 94 is trapped on the first surface 31. The dross 94 remaining on the first surface 31 is removed through the opening 55 regularly.

Figure 4:
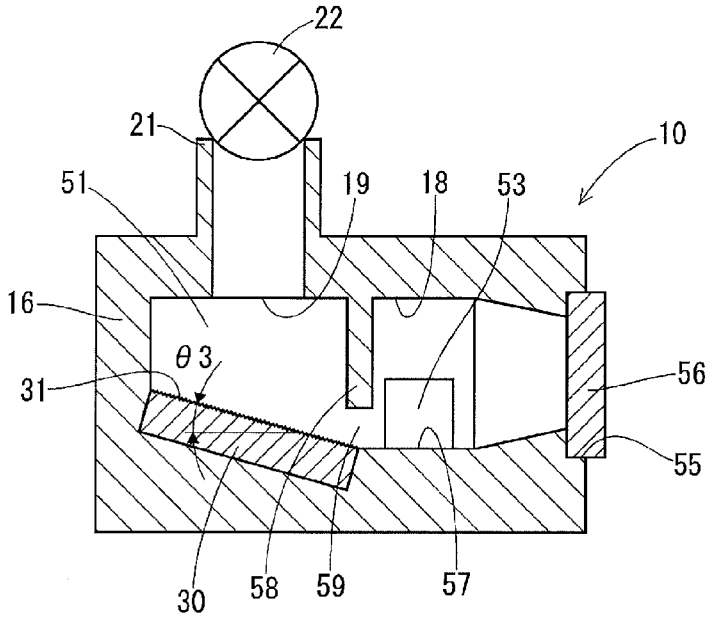
FIG. 4 is a cross-sectional view taken from line IV-IV of FIG. 2.
Figure 5:
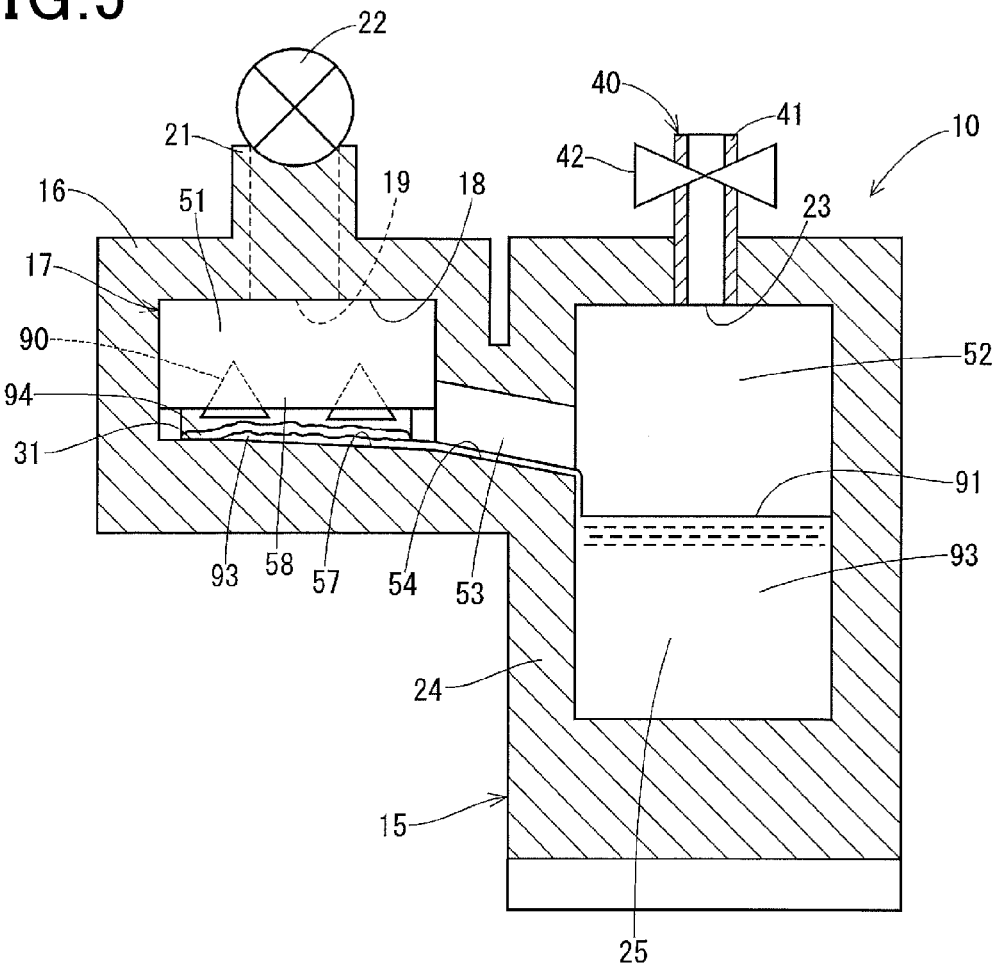
FIG. 5 is a diagram showing material being supplied to a first space of a melting chamber shown in FIG. 2 and melting.
Figure 6:
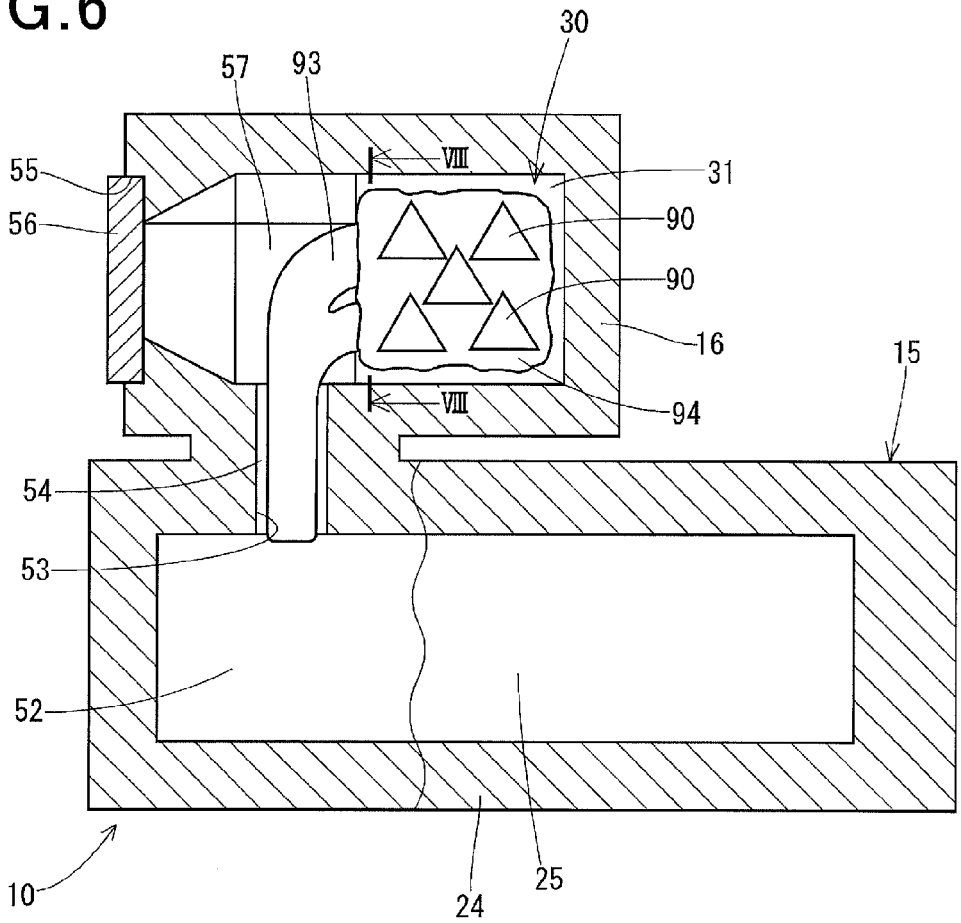
FIG. 6 is a diagram showing material being supplied to the first space of a melting chamber shown in FIG. 3 and melting.
Figure 7:
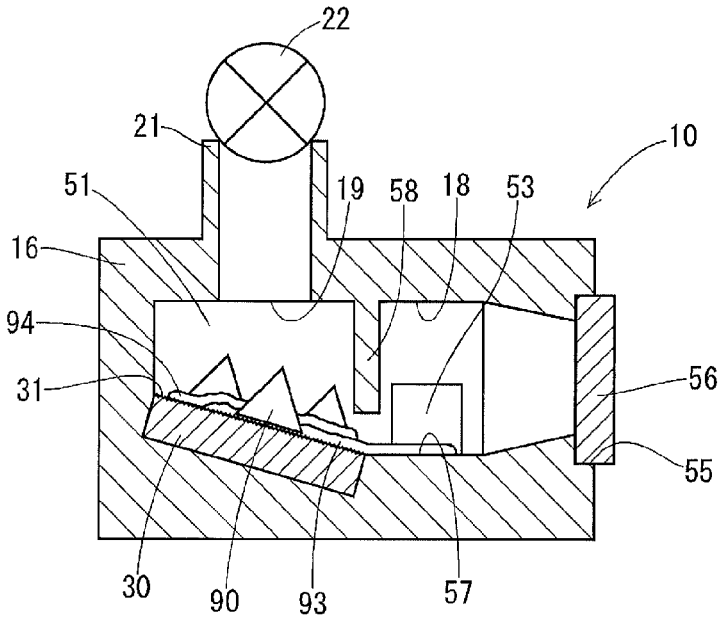
FIG. 7 is a diagram showing material being supplied to the first space of a melting chamber shown in FIG. 4 and melting.

The furnace body 15 has a separator 58 formed to block a part of the passage of the material 90 from the first surface 31 outward except for a gap 59. Specifically, in this embodiment, as shown in FIGS. 2 and 4, the separator 58 is a wall member extending from the ceiling surface 18 of the melting chamber 17 toward the first surface 31.

The size of the gap 59 is set to block the material 90 before melting. Specifically, in this embodiment, the height of the gap 59 between the separator 58 and the first surface 31 is set smaller than the height of the material 90 laid on the first surface 31 before melting. That is, the separator 58 is a stopper that prevents the material 90 from falling from the first surface 31 to mildly-oblique surface 57 before melting. It is noted that the illustration of the separator 58 is omitted in FIG. 3.

The first passage 25 extends obliquely downward from the second space 52 of the holding chamber 14 toward the second passage 27. The second heater 36 is obliquely inserted inside of the furnace body 15 through an insertion hole 28 formed at a higher position than the position of the first top surface 91, and extends along the first passage 25. It is noted the illustration of the second heater 36 is omitted in FIG. 3.

The gas supply port 23 is formed at the second space 52. The pressure means 40 supplies the second space 52 compressed air to pressurize the top surface 91 of the molten metal 93 in the first passage 25. The first and second passages 25, 27 are formed such that the area of the first top surface 91 is larger than the area of the second top surface 92. Accordingly, when the pressure means 40 applies pressure on the first top surface 91, the change of height of the first top surface 91 is smaller than that of height of the second top surface 92.

As described above, in the first embodiment, the first surface 31 of the hot plate 30 has the concavities and convexities. The concavities and convexities are formed such that the surface roughness of the first surface 31 is larger than that of the bottom surface 54 of the communicating passage 53.

Therefore, the dross 94 occurs on the first surface 31 to cover the molten metal 93 in a state where a part of the dross 94 is trapped in the concavities and convexities, and most of the dross 94 remains on the first surface 31. The dross 94 remaining on the first surface 31 is removed through the opening 55 of the furnace body 15 regularly. Accordingly, the dross 94 is prevented from flowing into the molten metal in the first passage 25, which can secure good quality molten metal.

Here, the molten metal 93 flowing from the first surface 31 is not always free from impurities. There is not only the dross 94 remaining on first surface 31 but also impurities mixed in the molten metal 93 and flowing out from the first surface 31. The impurities flowing out from the first surface 31 might flow into the first passage 25 to sink in the molten metal pooled in the first passage 25.

For solving this, in the first embodiment, the mildly-oblique surface 57 is provided between the first surface 31 and the bottom surface 54 of the communicating passage 53. The oblique angle of the mildly-oblique surface 57 to the horizontal plane is set smaller than that of the first surface 31 and the bottom surface 54.

Compared with no mildly-oblique surface 57, providing the mildly-oblique surface 57 increases the time taken for the molten metal 93 to flow into the first passage 25 after flowing out from the first surface 31. Accordingly, the impurities flow out from the first surface 31 and are separated from the molten metal 93 to be changed into the dross 94 over an increased time, and thereafter flows into the first passage 25 to remain at the top of the molten metal 93 in the first passage 25. Hence, the impurities flowing into the first passage 25 are prevented from sinking into the pooled molten metal. The dross remaining at the top of the pooled molten metal is regularly removed through an unshown window provided at the upper side of the furnace body 15 for cleaning.

Further, in the first embodiment, the opening of the furnace body 15 is disposed in the downward direction of the first surface 31. Accordingly, the dross 94 deposited on the first surface 31 can be removed through the opening 55 of the furnace body 15 regularly.

In the first embodiment, the furnace body 15 has the separator 58 extending from the ceiling surface 18 toward the first surface 31. The gap 59 between the separator 58 and the first surface 31 is set smaller than the material 90. The separator 58 can prevent the material introduced into the first space 51 from falling on the mildly-oblique surface 57 from the first surface 31 before melting.

In the first embodiment, the gas supply port 23 is formed on the second space 52 side. The pressure means 40 supplies the second space 52 compressed air to pressurize the first top surface 91 of the molten metal 93 in the first passage 25.

Here, if the compressed air is supplied to the first space 51, the compressed air pushes the dross 94 already in the first space 51, thereby the dross 94 flows into the communicating passage 53 easily. According to the first embodiment, this problem can be avoided.

In the first embodiment, the second heater 36 is obliquely inserted inside of the furnace body 15 through the insertion hole 28 formed at a higher position than the position of the first top surface 91. Accordingly, outside leakage of the molten metal 93 through the insertion hole 28 such as when the heater 36 breaks can be prevented.

In the first embodiment, the area of the first top surface 91 is larger than that of the second top surface 92. Accordingly, when the pressure means 40 applies pressure on the first top surface 91, the change of height of the first top surface 91 is smaller than that of the second top surface 92. Therefore, the oxides is prevented from depositing on the inner wall surface near the first top surface 91 in the furnace body 15, which secures good quality of the molten metal.

(Second Embodiment)

Figure 9:
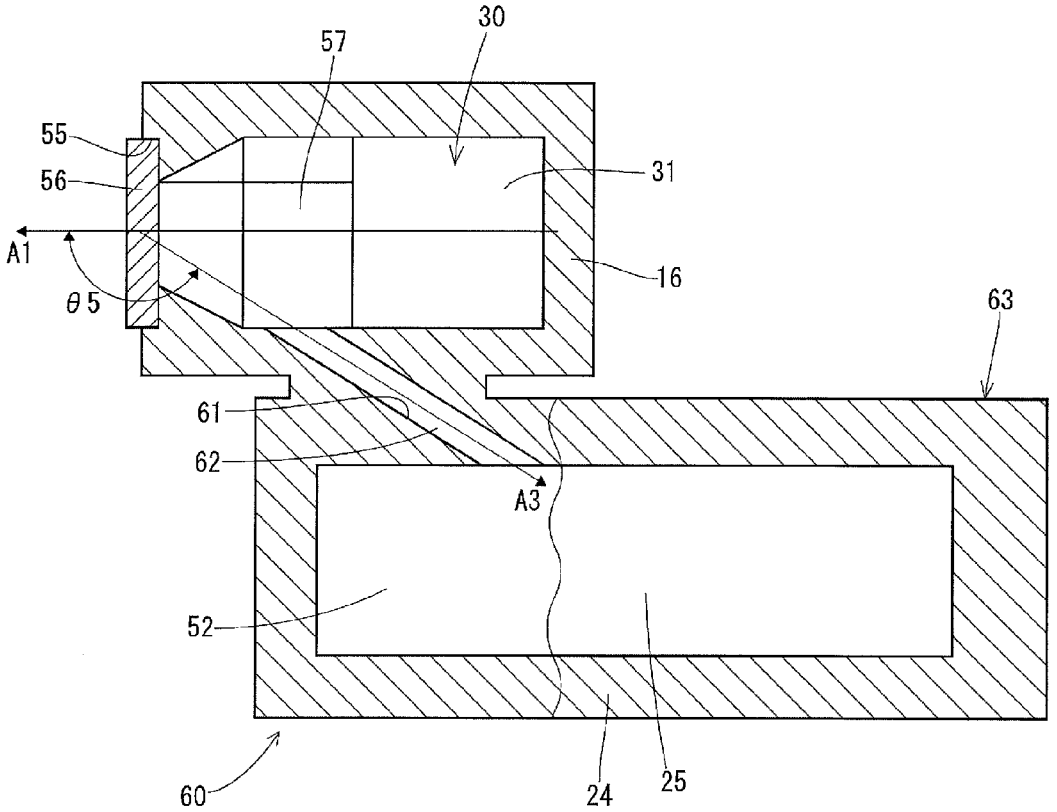
FIG. 9 is a cross-sectional view showing a casting machine according to a second embodiment, corresponding to FIG. 3 of the first embodiment.

A casting machine according to a second embodiment is now described, referring to FIG. 9. It is noted that only the points different from the first embodiment is described, the description of the same points are omitted.

In FIG. 9, the downward direction of the oblique directions of the bottom surface 62 of the communicating passage 61, the second direction, is shown with the arrow A3. When the furnace body 63 is viewed from above, i.e. viewed along the vertical direction, the first direction A1 and the second direction A3 intersect with each other, and the intersection angle θ5 between the first and second directions A1, A3 is 120°. The opening 55 of the furnace body 63 is disposed to the downside in the oblique direction of the first surface 31 and to the upside in the oblique direction of the bottom surface 62 of the communicating passage 61.

According to the second embodiment, the communicating passage 61 can be easily cleaned through the opening 55 of the furnace body 63.

(Third Embodiment)

Figure 10:
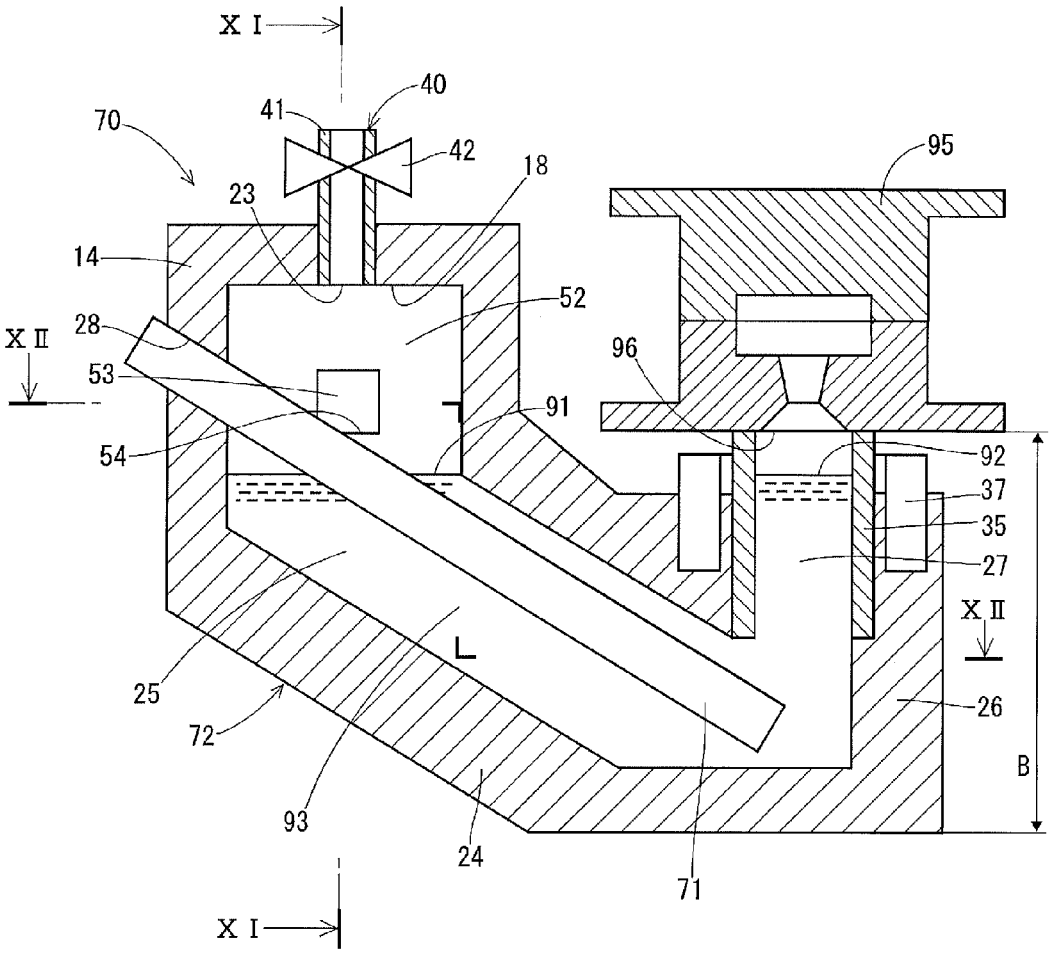
FIG. 10 is a cross-sectional view showing a schematic configuration of a casting machine according to a third embodiment.
Figure 11:
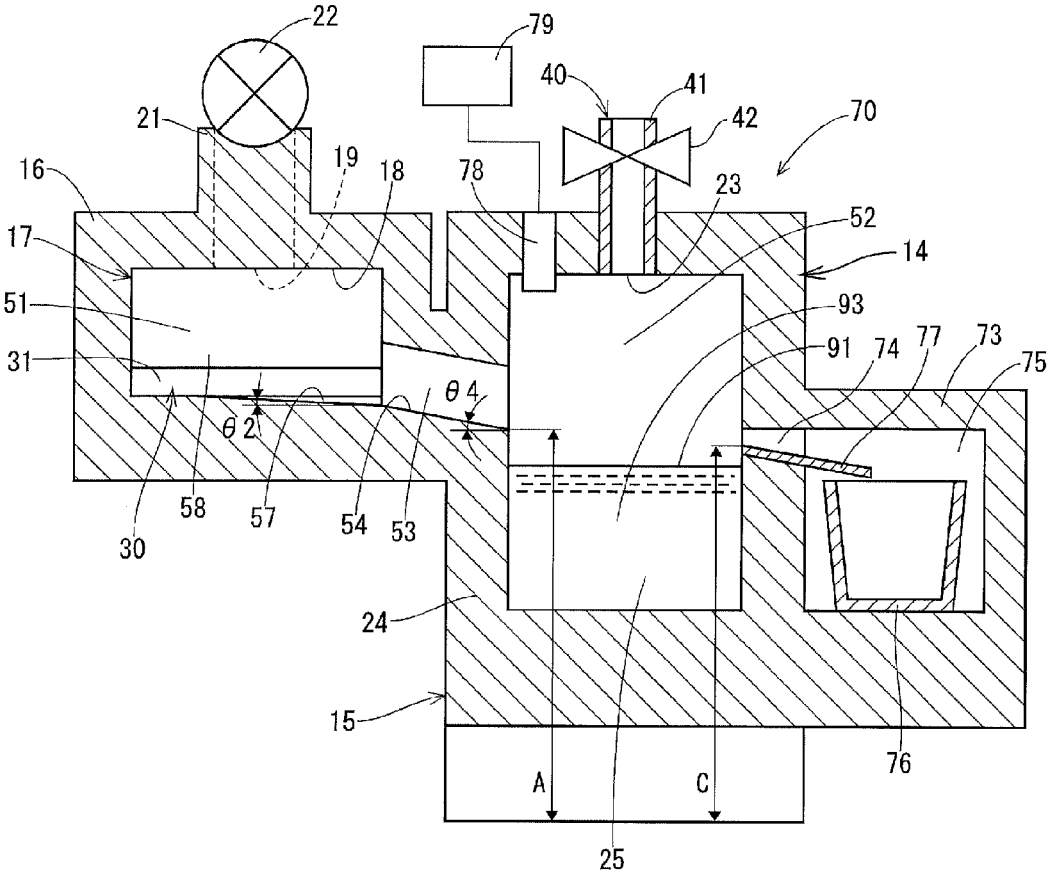
FIG. 11 is a cross-sectional view taken from line XI-XI of FIG. 10.
Figure 12:
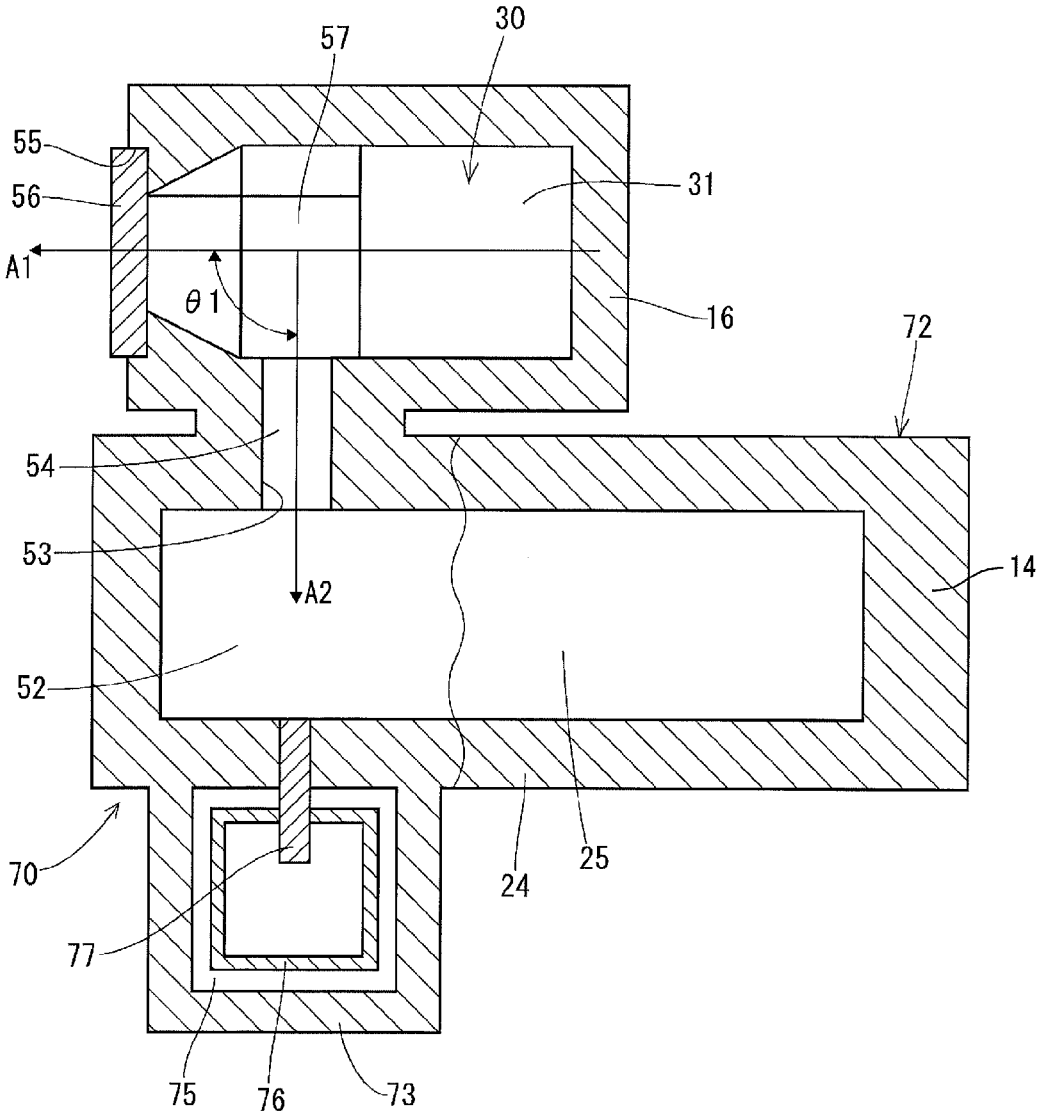
FIG. 12 is a cross-sectional view taken from line XII-XII of FIG. 10.

A casting machine according to a third embodiment is now described, based on FIGS. 10 to 12. It is noted that only the points different from the first embodiment is described, the description of the same points are omitted.

In the third embodiment, the second heater 71 extends just under the stalk 35 in an installed condition of the casting machine 70. Thus, since the second heater 71 extends over all of the furnace body 72, unequal distribution of the molten metal in the furnace body 72 is prevented. This can prevent local high temperature of the molten metal from causing promotion of generating oxides.

Further, in the third embodiment, the furnace body 72 has a position sensor 78 sensing the height of the top surface 91 of the molten metal in the first passage 25. The electronic control unit 79 provided for the casting machine 70 calculates, on the basis of the height of the top surface 91 sensed with the position sensor 78, the rest of the amount to the upper limit of the amount of the molten metal which the holding portion 24 and the output portion 26 can hold, i.e. the amount from the present amount until overflowing from the first passage 25 to an overflow portion 73 (described below). Thereafter, the control unit 79 determines, on the basis of the calculated amount, the supply amount of the material 90 to the melting portion 16. An unshown material supply device supplies the material 90 of the amount depending on the determined supply amount. Accordingly, the control unit 79 controls the supply amount of the material 90 to the melting portion 16 and the output amount from the output portion 26 to prevent overflowing.

In addition, in the third embodiment, the furnace body 72 has the overflow portion 73. The overflow portion 73 has an overflow passage 74 and an overflow chamber 75. The overflow passage 74 is connected to the first passage 25 at the position having lower height C than the height A and the height B, the height A being the height of the position of the lowest part in the communicating passage 53 and the height B being the height of the outlet port of the stalk 35. It is noted the height A, B and C is the height from the installation surface of the casting machine 70. The overflow chamber 75 holds the molten metal flowing away from the first passage 25 through the overflow passage 74. A case 76 that receives the molten metal inflowing through the overflow passage 74 is provided in the overflow chamber 75. A gutter 77 made of heat insulating materials is provided between the overflow passage 74 and the case 76. Accordingly, for example, when an excessive amount of the material 90 is supplied to the melting portion 16 because of a glitch of the control unit 79, the excessive molten metal can be pooled in the case 76 of the overflow chamber 75 through the overflow passage 74. Therefore, the excessive molten metal can be prevented from leaking from the outlet port of the stalk 35. Further, the molten metal pooled in the case 76 can be removed easily by exchanging the case 76 to an empty case 76.

(Other Embodiments)

The concavities and convexities on the first surface is not limited to the conical projections 32, alternatively, may be formed with, for example, columnar or long and thin projections. Further, the concavities and convexities on the first surface may be irregular concavities and convexities.

The first surface of the hot plate may be made of materials other than silicon nitride.

The first heater is not limited to the hot plate 30. For example, as the first heater, a combination of a plate and a heater or an induction heating coil provided under the plate may be used.

The furnace body is not limited to have the first and second spaces separated by the chamber walls having the communicating passage, alternatively, may have one space without separating the first and second spaces. Further, the first surface may be connected directly to the first passage without the mildly-oblique surface on the floor surface of the melting chamber.

The first surface may be provided in parallel with the horizontal plane. That is, the first surface need not be oblique. The first surface is disposed at higher position than the position of the first top surface of the first passage.

When the furnace body is viewed along the vertical direction, the intersection angle between the downward direction (first direction) of the oblique directions of the first surface and the downward direction (second direction) of the oblique directions of the bottom of the communicating passage need not be 90 degrees or 120 degrees.

The separator as a stopper in the melting chamber need not be provided.

The area of the first top surface and the area of the second top surface may be same.

The pressure means may supply the first space compressed air.

Although, in the first embodiment, the concavities and convexities are formed along the oblique direction and along the direction perpendicular to the oblique direction, alternatively the concavities and convexities may be formed along only one direction.

The present invention is not limited to the above-described embodiments. Modifications can be made accordingly without departing from the scope of the present invention.

What is claimed is:

1. A casting machine for pouring molten metal into a die, the machine comprising:

a furnace body having a melting portion and a holding portion, material being supplied and melted to be the molten metal in the melting portion, the holding portion holding the molten metal which has flowed out from the melting portion;

a first heater heating the material supplied to the melting portion to melt;

a first surface provided on a hearth surface of the melting portion and having concavities and convexities, the molten metal flowing out from the melting portion flows transversely over the concavities and convexities of the first surface; and pressurizing unit that pressurizes the molten metal to be forced into the die.

2. The casting machine according to claim 1, further comprising a communicating passage connected between the first surface and the holding portion, the communicating passage having a bottom surface on which the molten metal flows, the bottom surface being oblique downward toward the holding portion, wherein the first surface is oblique downward toward the communication passage.

3. The casting machine according to claim 2, further comprising an oblique surface provided between the first surface and the communicating passage, the oblique surface being oblique downward toward the holding portion, and an angle of the oblique surface to the horizontal plane being smaller than that of the bottom surface.

4. The casting machine according to claim 2, wherein surface roughness of the first surface is larger than that of the bottom surface.

5. The casting machine according to claim 2, further comprising an opening provided at the furnace body in the downward direction of the first surface and in the upward direction of the communicating passage.

6. The casting machine according to claim 2, further comprising a separator configured to block an upper part of the material, the separator extending down from a ceiling surface of the melting portion to above the first surface to form a gap between the separator and the first surface.

7. The casting machine according to claim 2, wherein the furnace body has a division wall dividing between a first space and a second space, the first surface disposed in the first space, the second space being disposed over the holding portion, and the division wall having a penetrating hole communicating between the first space and the second space as the communicating passage, and the pressurizing unit supplies gas to the second space.

8. The casting machine according to claim 2, wherein the first heater is a hot plate having a heating surface corresponding to the first surface.

9. The casting machine according to claim 2, wherein the furnace body has a first passage extending downward and a second passage connected to a lower end of the first passage and extending upward, the first passage corresponding to the holding portion, and the pressurizing unit pressurizes the top of the molten metal in the first passage to push the top of the molten metal in the second passage up, thereby forcing the molten metal into the die.

10. The casting machine according to claim 9, further comprising a second heater inserted in the holding portion from a position of the furnace body higher than the top of the molten metal in the first passage.

11. The casting machine according to claim 10, further comprising a connection member connecting the second passage and the die, wherein the second heater extends obliquely downward to below the connection member.

12. The casting machine according to claim 11, wherein the first passage extends obliquely downward to below the connection member; and the second heater extends along the first passage to below the connection member.

13. The casting machine according to claim 9, wherein the area of a top surface of the molten metal in the first passage is larger than that of a top surface of the molten metal in the second passage.

14. The casting machine according to claim 9, further comprising an overflow passage connected to the first passage at a position lower than the lowest position of the communicating passage and an outlet port of the molten metal connected to the die.

15. The casting machine according to claim 1, wherein the concavities and the convexities are formed along a flow direction of the molten metal which has been melted.

16. The casting machine according to claim 1, wherein the convexities project upward and the concavities recess downward and are formed between the convexities.

* * * * *